US009487028B2

(12) United States Patent
Motosugi et al.

(10) Patent No.: US 9,487,028 B2
(45) Date of Patent: Nov. 8, 2016

(54) DRYING DEVICE, IMAGE FORMING APPARATUS AND COMPUTER READABLE MEDIUM

(71) Applicant: FUJI XEROX CO., LTD., Tokyo (JP)

(72) Inventors: Yukari Motosugi, Kanagawa (JP); Takeshi Zengo, Kanagawa (JP); Takuma Ishihara, Kanagawa (JP); Jun Isozaki, Kanagawa (JP); Akira Sakamoto, Kangawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/709,544

(22) Filed: May 12, 2015

(65) Prior Publication Data

US 2016/0167398 A1 Jun. 16, 2016

(30) Foreign Application Priority Data

Dec. 15, 2014 (JP) ..... 2014-253348

(51) Int. Cl.
*B41J 11/00* (2006.01)
*B41J 2/14* (2006.01)

(52) U.S. Cl.
CPC ..... *B41J 11/002* (2013.01); *B41J 2/14104* (2013.01)

(58) Field of Classification Search
CPC ..... B41J 11/42; B41J 29/393; B41J 29/38; B41J 3/60; B41J 11/0095; B41J 2/14104; B41J 11/002
USPC ..... 347/16
See application file for complete search history.

(56) References Cited

U.S. PATENT DOCUMENTS

| | | | | |
|---|---|---|---|---|
| 7,895,968 | B2 | 3/2011 | Miura | |
| 2006/0244808 | A1 | 11/2006 | Miura | |
| 2010/0154244 | A1* | 6/2010 | Kuta | F26B 3/28 34/275 |
| 2014/0168307 | A1* | 6/2014 | Silveston-Keith | B41J 11/009 347/16 |

FOREIGN PATENT DOCUMENTS

| | | | | |
|---|---|---|---|---|
| JP | 4432817 | | 1/2010 | |
| JP | 2014-83762 | | 5/2014 | |
| JP | 2014-083762 | * | 5/2014 | B41J 2/01 |
| JP | 2014-083762 A | * | 5/2014 | B41J 2/01 |

OTHER PUBLICATIONS

Abstract and machine translation of JP2014-083762.
Abstract and machine translation of JP4432817.

* cited by examiner

*Primary Examiner* — Manish S Shah
*Assistant Examiner* — Yaovi M Ameh
(74) *Attorney, Agent, or Firm* — Fildes & Outland, P.C.

(57) ABSTRACT

A drying device includes: a drying unit that includes a laser light source group in which a plurality of laser light sources are arranged two-dimensionally and that dries ink placed on a recording medium as a result of ejecting of ink droplets from an ejecting unit by irradiating the ink with laser light; a control unit that divides the laser light source group into unit-of-control laser light source groups that are arranged in a crossing direction that crosses a feeding direction of the recording medium and each of which has, as a unit of control, a plurality of laser light sources arranged in the feeding direction of the recording medium, and controls the drying unit using laser light irradiation profiles that are set for the respective unit-of-control laser light source groups; and a setting unit as defined herein.

10 Claims, 8 Drawing Sheets

FIG. 6D
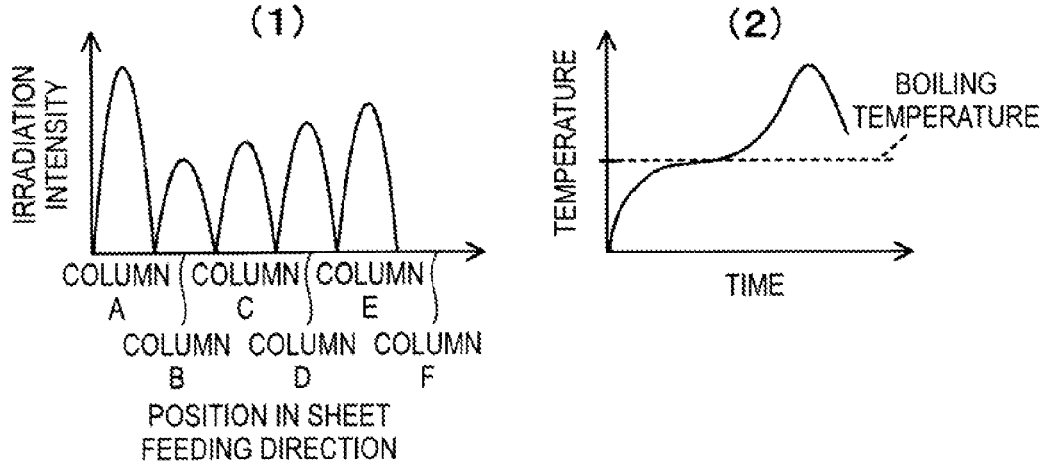
FIG. 6E
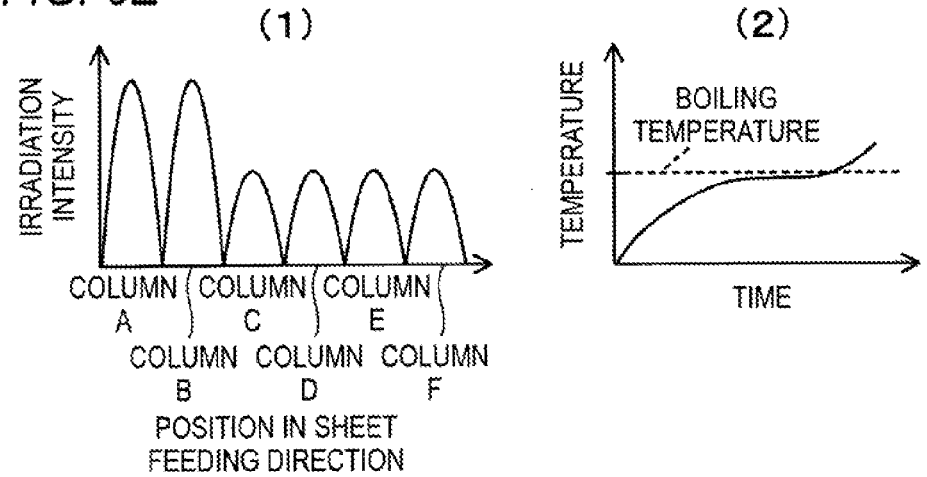
FIG. 7A
| COLUMN A | | | | COLUMN B | | | | COLUMN C | | | | ··· |
|---|---|---|---|---|---|---|---|---|---|---|---|---|
| 1.5 | 1.5 | 1.5 | ··· | 1.5 | 1.5 | 1.5 | ··· | 1.5 | 1.5 | 1.5 | ··· | ··· |
FIG. 7B
| COLUMN A | | | | COLUMN B | | | | COLUMN C | | | | ··· |
|---|---|---|---|---|---|---|---|---|---|---|---|---|
| 1.5 | 1.5 | 1.5 | ··· | 0.75 | 0.75 | 0.75 | ··· | 0.75 | 0.75 | 0.75 | ··· | ··· |

| UNIT-OF-CONTROL ROW | IRRADIATION PROFILE | IRRADIATION INTENSITY FACTOR | INK SMUDGE | OPTICAL DENSITY |
|---|---|---|---|---|
| 1 - 1 | 1 | 0.8 | FOUND | 1.10 |
| 1 - 2 | 1 | 0.9 | NOT FOUND | 1.15 |
| 1 - 3 | 1 | 1.0 | NOT FOUND | 1.15 |
| 2 - 1 | 1 | 1.1 | FOUND | 1.15 |
| 2 - 2 | 2 | 0.8 | FOUND | 1.10 |
| 2 - 3 | 2 | 0.9 | FOUND | 1.15 |
| 3 - 1 | 2 | 1.0 | NOT FOUND | 1.20 |
| 3 - 2 | 2 | 1.1 | NOT FOUND | 1.20 |
| 3 - 3 | 3 | 0.8 | FOUND | 1.15 |
| 4 - 1 | 3 | 0.9 | FOUND | 1.20 |
| 4 - 2 | 3 | 1.0 | NOT FOUND | 1.25 |
| 4 - 3 | 3 | 1.1 | NOT FOUND | 1.20 |
| ⋮ | ⋮ | ⋮ | ⋮ | ⋮ |

DRYING DEVICE, IMAGE FORMING APPARATUS AND COMPUTER READABLE MEDIUM

CROSS-REFERENCE TO RELATED APPLICATIONS

This application is based on and claims priority under 35 USC 119 from Japanese Patent Application No. 2014-253348 filed on Dec. 15, 2014.

BACKGROUND

Technical Field

The present invention relates to a drying device, an image forming apparatus, and a computer readable medium storing a program causing a computer to function as a control unit and a setting unit of the drying device.

SUMMARY

According to an aspect of the invention, there is provided a drying device including: a drying unit that includes a laser light source group in which plural laser light sources are arranged two-dimensionally and that dries ink placed on a recording medium as a result of ejecting of ink droplets from an ejecting unit by irradiating the ink with laser light; a control unit that divides the laser light source group into unit-of-control laser light source groups that are arranged in a crossing direction that crosses a feeding direction of the recording medium and each of which has, as a unit of control, plural laser light sources arranged in the feeding direction of the recording medium, and controls the drying unit using laser light irradiation profiles that are set for the respective unit-of-control laser light source groups; and a setting unit that causes the drying unit to radiate laser light on a test image formed on the recording medium by ink droplets ejected from the ejecting unit using different irradiation profiles for the respective unit-of-control laser light source groups, and sets an irradiation profile that provides an evaluation result, better than or equal to a reference, of the test image as irradiated with laser light for laser light sources belonging to each of the unit-of-control laser light source groups.

BRIEF DESCRIPTION OF THE DRAWINGS

Exemplary embodiments of the present invention will be described in detail based on the following figures, wherein:

FIG. 6D is that Part (1) of FIG. 6D is a graph showing a relationship between the position of a VCSEL array subgroup in the sheet feeding direction and the laser light irradiation intensity in the case of a fourth irradiation profile used in the exemplary embodiment, and part (2) of FIG. 6D is a graph showing a relationship between the laser light irradiation time and the ink temperature when laser light irradiation is performed according to the fourth irradiation profile;

FIG. 6E is that Part (1) of FIG. 6E is a graph showing a relationship between the position of a VCSEL array subgroup in the sheet feeding direction and the laser light irradiation intensity in the case of a fifth irradiation profile used in the exemplary embodiment, and part (2) of FIG. 6E is a graph showing a relationship between the laser light irradiation time and the ink temperature when laser light irradiation is performed according to the fifth irradiation profile;

FIG. 7A shows an example laser light irradiation table corresponding to a first irradiation profile used in the exemplary embodiment;

FIG. 78B shows an example laser light irradiation table corresponding to a second irradiation profile used in the exemplary embodiment.

DESCRIPTION OF SYMBOLS

Figure 1:
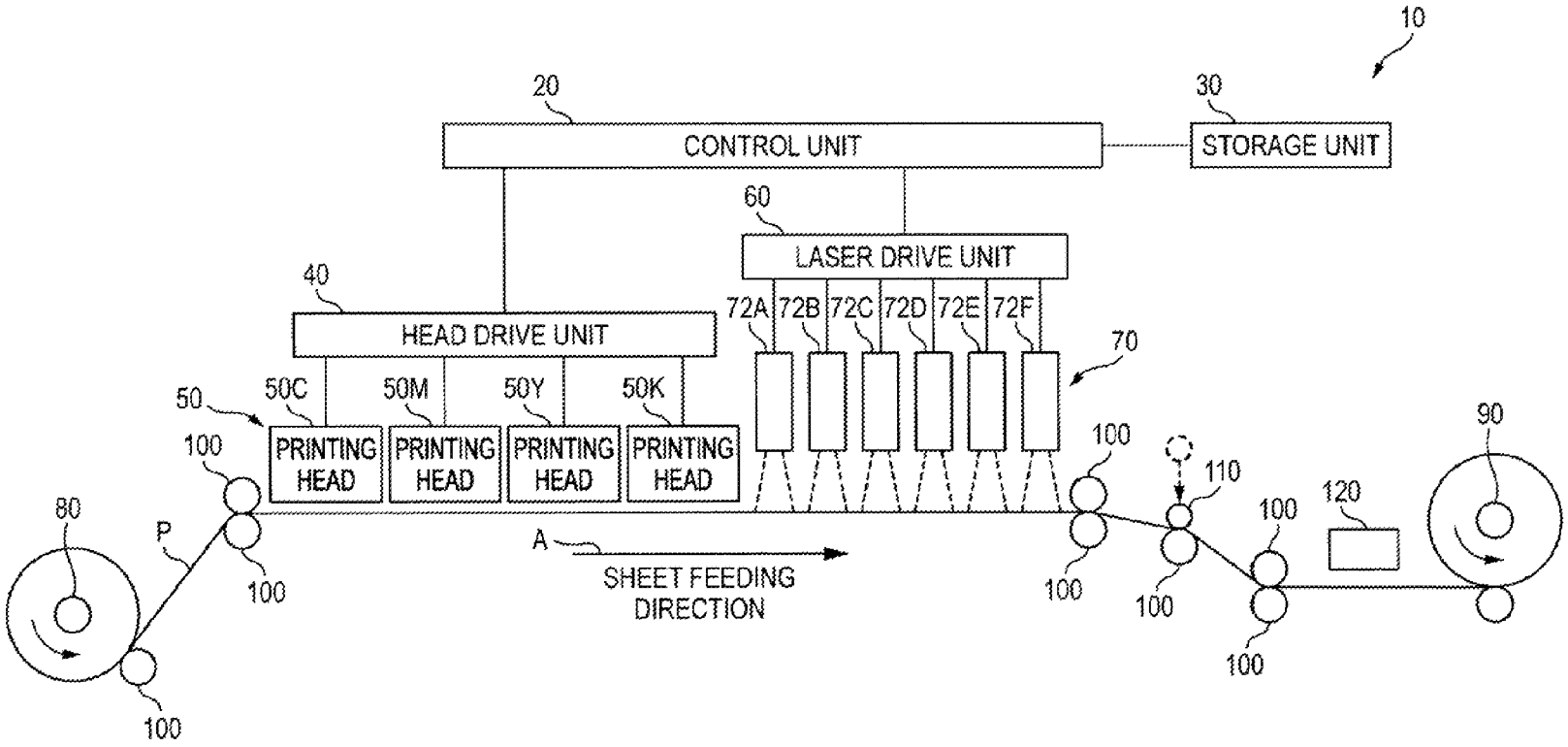
FIG. 1 schematically shows an essential configuration of an inkjet recording apparatus according to an exemplary embodiment.

10: Image forming apparatus
20: Control unit
50: Printing heads
70: Laser drying device
76: VCSEL array
120: Image reading unit
P: Continuous sheet

DETAILED DESCRIPTION

An exemplary embodiment of the present invention will be hereinafter described in detail with reference to the drawings. The exemplary embodiment is directed to a case that the invention is applied to an inkjet recording apparatus which records an image by ejecting ink droplets onto a recording medium.

Exemplary Embodiment 1

First, the configuration of an inkjet recording apparatus 10 according to the exemplary embodiment will be described. As shown in FIG. 1, the inkjet recording apparatus 10 according to this exemplary embodiment is equipped with a control unit 20, a storage unit 30, a head drive unit 40, printing heads 50, a laser drive unit 60, a laser drying device 70, a unwind roll 80, a rewind roll 90, feeding rollers 100, a pressing roller 110, and an image reading unit 120.

The control unit 20 controls the rotation of the feeding rollers 100 which are connected to a feeding motor 150 (see FIG. 3) by such a mechanism as gears by driving the feeding motor 150. A long, continuous sheet P (recording medium) is wound on the unwind roll 80 and is fed in a feeding direction A shown in FIG. 1 as the feeding rollers 100 are rotated. In the following description, the direction in which the continuous sheet P is fed (i.e., the direction A shown in FIG. 1) will be referred simply as a "feeding direction."

The storage unit 30 is a nonvolatile storage unit such as an HDD (hard disk drive). The control unit 20 acquires image information that is stored in the storage unit 30 and a user wants to be printed on the continuous sheet S, that is, user image information, and controls the head drive unit 40 on the basis of pixel-by-pixel color information included in the user image information. The head drive unit 40 drives the printing heads 50 connected to it according to ink droplets ejecting timing commanded by the control unit 20, and thereby causes the printing heads 50 connected to the head drive unit 40 to eject ink droplets onto the continuous sheet P being fed. As a result, an image corresponding to the user image information is formed on the continuous sheet P being fed. In the following description, an image that is formed on the continuous sheet P according to user image information will be referred to as a "user image."

Color information of each pixel of a user image includes information indicating a color of the pixel uniquely. Although in the exemplary embodiment the color information of each pixel of a user image is represented by densities of, for example, yellow (Y), magenta (M), cyan (C), and black (K), any of other representation methods capable of representing a color of each pixel of a user image uniquely may be used.

The printing heads 50 are four printing heads 50Y, 50M, 50C, and 50K which correspond to the four respective colors Y, M, C, and K, and each printing head 50 ejects ink droplets of a corresponding color from its ink ejecting outlet. There are no limitations on the drive method for causing each printing head 50 to eject ink droplets; any of known drive methods such as a thermal method and a piezoelectric method may be employed.

Whereas there are various kinds of inks such as water-based inks, solvent inks (i.e., inks containing a solvent that evaporates), and ultraviolet-curing inks, the exemplary embodiment employs water-based inks as an example. In the following description, when the term "ink" or "ink droplets" is used alone, it means a water-based ink or water-based ink droplets. The Y, M, C, and K inks used in the exemplary embodiment are added with an IR (infrared) absorbent and their degrees of laser light absorption are thereby adjusted, the invention is not limited to such a case. For example, an ink that absorbs laser light, such as a K ink, need not always be added with an IR absorbent.

The laser drive unit 60 is equipped with switching elements such as FETs (field-effect transistors) for on/off-controlling laser elements included in the laser drying device 70. The laser drive unit 60 adjusts the irradiation intensity (irradiation energy) of laser light emitted from each laser element by controlling the pulse duty ratio by driving the corresponding switching element under the control of the control unit 20.

By controlling the head drive unit 40, the control unit 20 causes the laser drying device 70 to radiate laser light on the surface on which an image is being formed of the continuous sheet P and thereby fixes a user image to the continuous sheet P by drying inks formed on thereon. In the following description, the surface on which an image is being formed of the continuous sheet P will be referred to as an "image forming surface." The continuous sheet P is thereafter fed to and taken up by the rewind roller 90 as the feeding rollers 100 are rotated.

The pressing roller 110 is disposed downstream of the laser drying device 70 in the feeding direction. Rotating under the control of the control unit 20, the pressing roller 110 contributes to the sheet feed. And the pressing roller 110 is pressed against the image forming surface of the continuous sheet P. As a result, if the fixing of inks of an image formed on the continuous sheet P is incomplete, the pressing roller 110 causes ink smudge to be stuck to a portion, adjacent to the subsequent area of the image, of the continuous sheet P. Although as shown in FIG. 1 the pressing roller 110 used in the embodiment is moved to a position (hereinafter referred to as a "pressing position") under the control of the control unit 20 when profile selection processing (described later) is performed, the invention is not limited to such a case; the pressing roller 110 may always be located at the pressing position.

The image reading unit 120 is disposed downstream of the pressing roller 110 at such a position as to be opposed to the image forming surface of the continuous sheet P. The image reading unit 120 reads an image formed on the image forming surface of the continuous sheet P and outputs image information representing the thus-read image to the control unit 20. Examples of the image reading unit 120 are a scanner and a camera.

Figure 2:
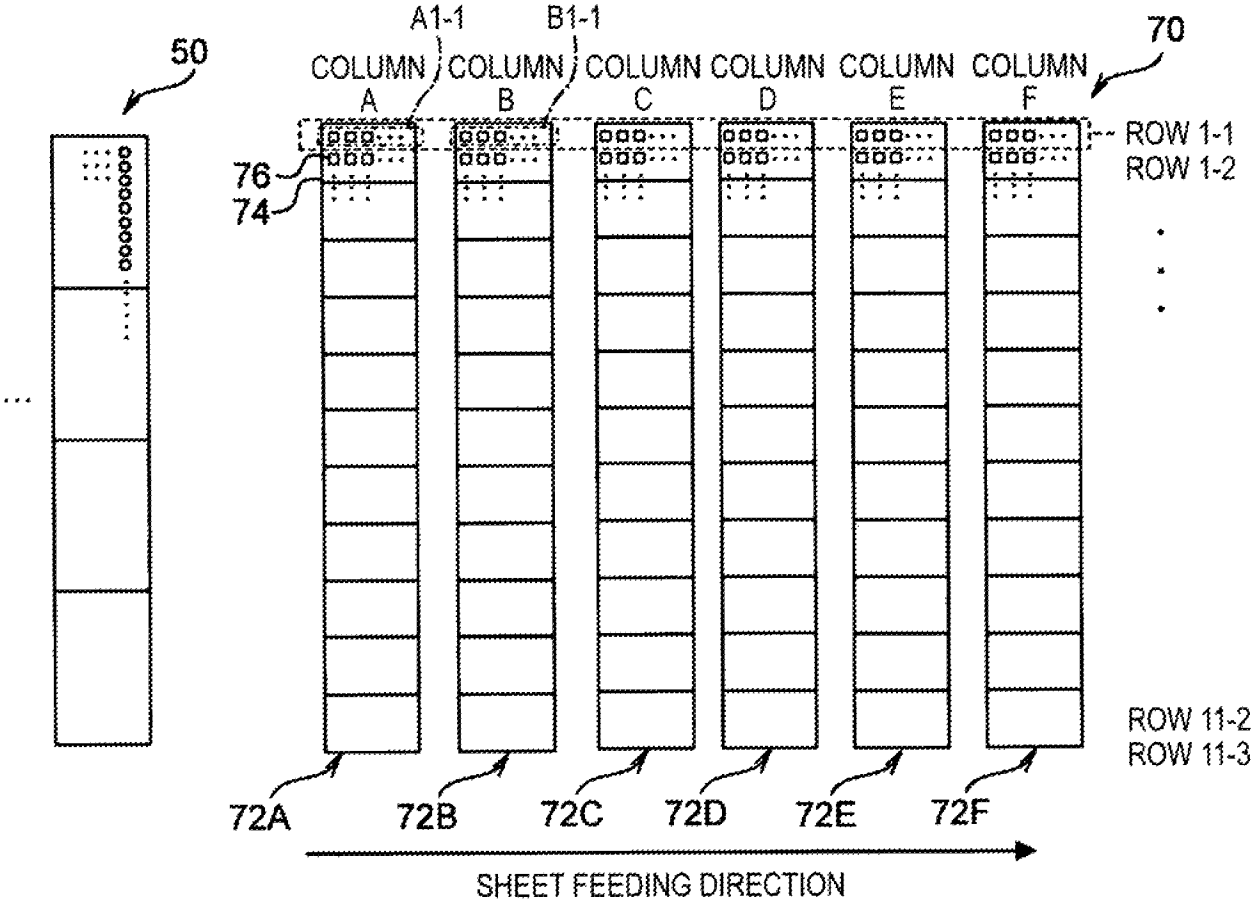
FIG. 2 is a plan view showing the structure of a laser drying device according to the exemplary embodiment.

Next, the configuration of the laser drying device 70 according to the exemplary embodiment will be described in detail with reference to FIGS. 1 and 2. As shown in FIGS. 1 and 2, the laser drying device 70 according to the exemplary embodiment is equipped with six laser drying units 72A-72F which are arranged in this order downstream in the feeding direction at prescribed intervals. In the following description, when it is not necessary to discriminate between the laser drying units 72A-72F, the alphabetical suffixes of these reference symbols will be omitted.

As shown in FIG. 2, each laser drying unit 72 is equipped with plural VCSEL (vertical cavity surface-emitting laser) array groups 74 which are arranged in a direction (hereinafter referred to as a "crossing direction") that crosses the feeding direction. Each VCSEL array group 74 is equipped with plural VCSEL arrays 76 that are arranged two-dimensionally, more specifically, arranged in lattice form in the feeding direction and the crossing direction. Each VCSEL array 76 is equipped with plural VCSELs (not shown). Each VCSEL array 76 is an example of the term "laser light source" as used in the claims.

In the laser drying device 70 according to the exemplary embodiment, a laser light irradiation profile (described later in detail) is set in such a manner that each row of VCSEL arrays 76 arranged in the feeding direction among the plural VCSEL arrays 76 arranged two-dimensionally serves as a unit of control. Controlled by the control unit 20, the VCSEL arrays 76 radiate laser light on the image forming surface of the continuous sheet P according to the thus-set irradiation profile. In FIG. 2, each group of VCSEL arrays 76 as a unit of control is indicated by a broken-line rectangle. In the laser drying device 70 according to the exemplary embodiment, as shown in FIG. 2, the VCSEL arrays 76 are grouped into, for example, row 1-1 to row 11-3 which are units of control, respectively. Furthermore, in FIG. 2, among the VCSEL arrays 76 constituting each unit of control, a subgroup of VCSEL arrays 76 included in each laser drying unit 72 is indicated by a chain-line rectangle (e.g., denoted by A1-1 or B1-1 in FIG. 2). Each row of VCSEL arrays 76 constituting a unit of control is an example of the term "unit-of-control laser light source group" as used in the claims, and each subgroup of VCSEL arrays 76 (e.g., denoted by A1-1 or B1-1 in FIG. 2) included in a laser drying unit 72 is an example of the term "laser light source subgroup."

Figure 3:
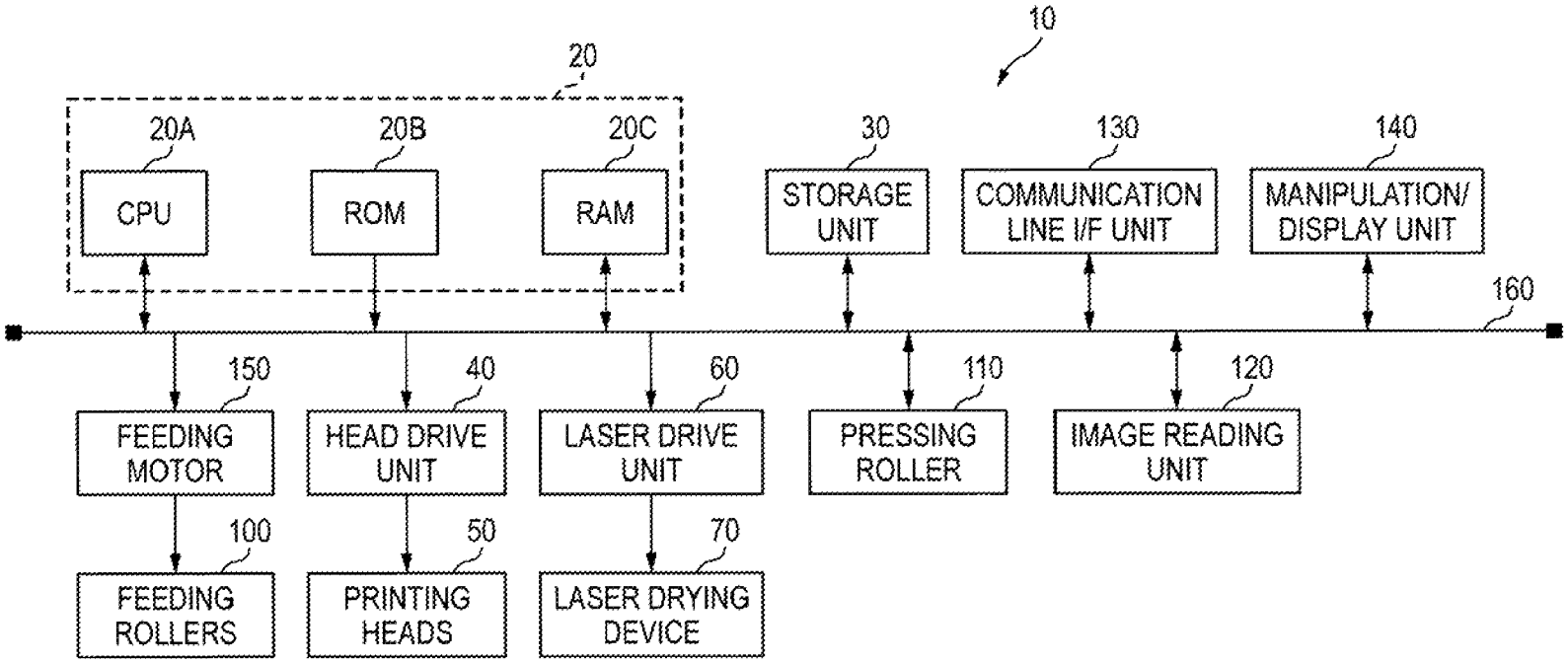
FIG. 3 is a block diagram showing the configuration of an essential electrical system of the inkjet recording apparatus according to the exemplary embodiment.

Next, the configuration of an essential electrical system of the inkjet recording apparatus 10 according to the exemplary embodiment will be described with reference to FIG. 3. As shown in FIG. 3, the control unit 20 of the inkjet recording apparatus 10 according to the exemplary embodiment is equipped with a CPU 20A which supervises the overall inkjet recording apparatus 10 and a ROM (read-only memory) 20B which is stored in advance with various kinds of programs, various kinds of parameters, etc. The control unit 20 is also equipped with a RAM (random access memory) 20C which serves as a working area or the like when the CPU 20A runs various kinds of programs.

The inkjet recording apparatus 10 is also equipped with a communication line interface (I/F) unit 130 for exchange of communication data with an external device, and a manipulation/display unit 140 which receives a user instruction to the inkjet recording apparatus 10 and gives a user various kinds of information relating to an operation status etc. of the inkjet recording apparatus 10. For example, the manipulation/display unit 140 includes a touch-screen display on which various kinds of information and buttons for reception of a manipulation instruction are displayed as a result of execution of programs, hardware keys such as a ten-key unit and a start button, and other things.

The CPU 20A, the ROM 20B, the RAM 20C, the storage unit 30, the head drive unit 40, the laser drive unit 60, the pressing roller 110, the image reading unit 120, the communication line I/F unit 130, the manipulation/display unit 140, and the feeding motor 150 are connected to each other by a bus 160 consisting of an address bus, a data bus, a control bus, etc. The printing heads 50 are connected to the head drive unit 40, the laser drying device 70 is connected to the laser drying device 70, and the feeding rollers 100 are connected to the feeding motor 150.

With the above electrical system configuration, the CPU 20A controls the head drive unit 40 via the bus 160 and thereby causes it to drive the printing heads 50 in the above-described manner. The CPU 20A controls the laser drive unit 60 via the bus 160 and thereby causes it to control laser light irradiation by the laser drying device 70 in the above-described manner. Furthermore, the CPU 20A controls the feeding motor 150 via the bus 160 and thereby causes it to control the rotation of the feeding rollers 100 in the above-described manner.

Still further, the CPU 20A controls, via the bus 160, rotation of the pressing roller 110 and movement of the pressing roller 110 to the pressing position. The CPU 20A acquires, via the bus 160, image information read by the image reading unit 120. Furthermore, the CPU 20A detects presence/absence of ink smudge and optical densities from the acquired image information. In the exemplary embodiment, the optical density means absorbance. The image quality of an image is considered higher as its image densities increase.

Figure 4A:
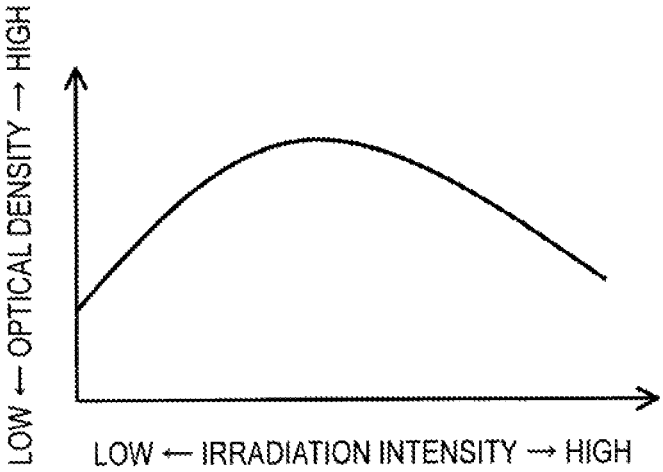
FIG. 4A is a graph showing a relationship between the laser light irradiation intensity and the optical density of an image.

Incidentally, in the inkjet recording apparatus 10 according to the exemplary embodiment, inks placed on the continuous sheet P as a result of ejecting of ink droplets onto the continuous sheet P from the printing heads 50 are required to be dried quickly. It is therefore conceivable to, for example, cause the laser drying device 70 to radiate laser light at an upper limit irradiation intensity. However, as exemplified in FIG. 4A, if the laser light irradiation intensity is too high, the optical densities of an image decrease contrary to the intention. One reason for this phenomenon is that the temperature of inks on the continuous sheet P becomes higher than their boiling temperature and parts of the inks scatter due to formation of air bubbles in the inks. Where water-based inks are used as in the exemplary embodiment, the boiling temperature of inks placed on a sheet is about 100° C. though it varies depending the air pressure etc. at a place of installation of an inkjet recording apparatus. In the following description, if the term "boiling temperature" is used alone, it means a boiling temperature of inks. If the term "irradiation intensity" is used alone, it means irradiation intensity of laser light.

Figure 4B:
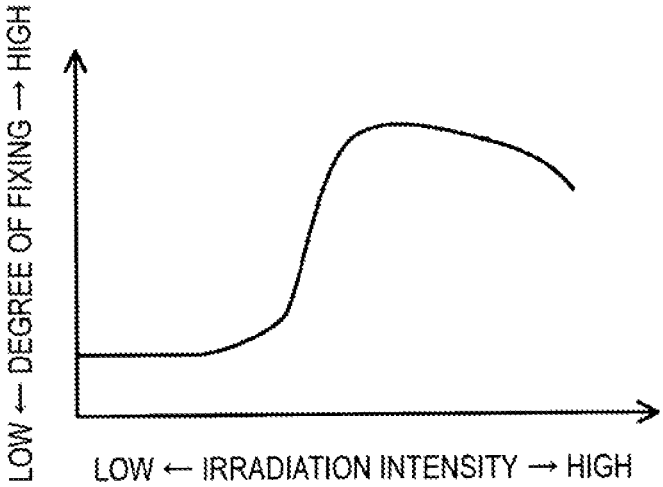
FIG. 4B is a graph showing a relationship between the laser light irradiation intensity and the degree of fixing of ink.

As exemplified in FIG. 4B, if the irradiation intensity is too low, water remains in inks without evaporating fully, resulting in a low degree of fixing of the inks to the continuous sheet P. On the other hand, if the irradiation intensity is too high, the temperature of inks on the continuous sheet P becomes higher than their boiling temperature and parts of the inks boil to scatter. In this case, asperities are formed in ink surfaces, resulting in a low degree of fixing of the inks to the continuous sheet P.

Furthermore, the ink temperature increase rate and the degree of fixing of inks to the continuous sheet P depend on the water content of the inks, the IR absorbent content, the paper quality of the continuous sheet P, and other factors.

Therefore, to suppress image quality degradation, it is important to dry inks by causing the laser drying device 70 to radiate laser light on the inks at a proper irradiation intensity. In view of this, the inkjet recording apparatus 10 according to the exemplary embodiment performs profile selection processing for selecting an irradiation profile according to which to radiate laser light on the inks with a proper irradiation intensity distribution.

Figure 5:
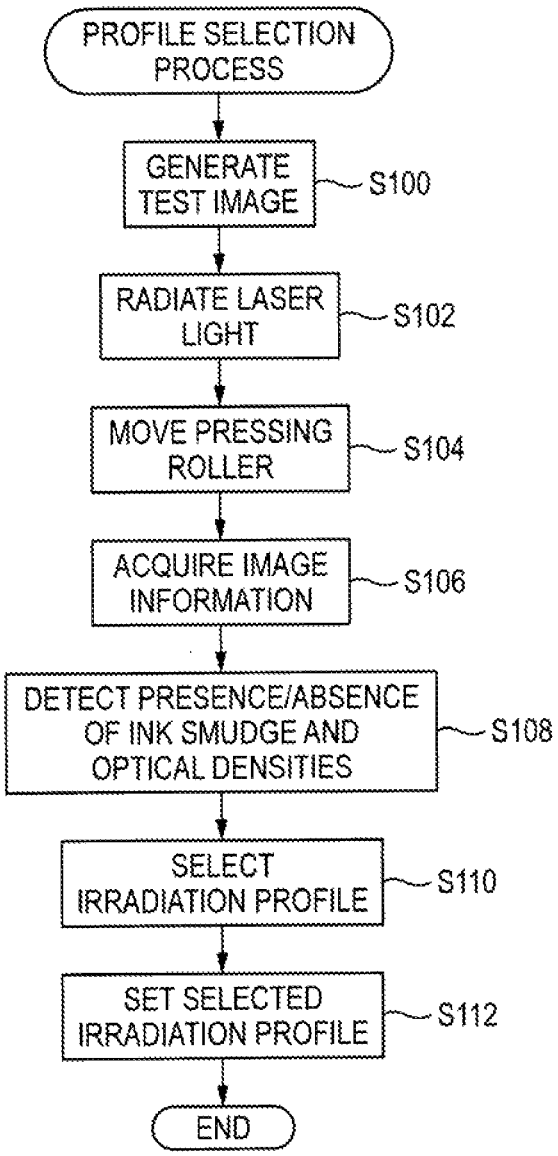
FIG. 5 is a flowchart showing the procedure of a profile selection program according to the exemplary embodiment.

Next, a description will be made of the workings of the inkjet recording apparatus 10 according to the exemplary embodiment with reference to FIG. 5. FIG. 5 is a flowchart showing the procedure of a profile selection program that is run by the CPU 20A upon ink type switching. This program is installed in the ROM 20B in advance. Although in the exemplary embodiment the profile selection program is run upon ink type switching, the invention is not limited to such a case. The profile selection program may be run with other timing, for example, upon switching of the continuous sheet type or carrying-out of regular maintenance work. Other example triggers for running of the profile selection program are carrying-out of special maintenance work and a user input of an instruction to start the profile selection program through the manipulation/display unit 140.

At step S100 shown in FIG. 5, the CPU 20A forms a test image having a predetermined size and a uniform density in a region of a continuous sheet P to be irradiated with laser light emitted from the laser drying device 70. More specifically, in the exemplary embodiment, the CPU 20A forms, for example, a rectangular, 100%-density K-color test image that has the same width in the crossing direction as the laser light irradiation region and measures 1.5 inches in the feeding direction.

At step S102, the CPU 20A causes the VCSEL arrays 76 to radiate laser light on the test image in such a manner that the combination of an irradiation profile and an irradiation intensity factor varies from one unit-of-control VCSEL array group to another.

Now, referring to FIGS. 6A-6E, a description will be made of irradiation profiles used in the exemplary embodiment. In the exemplary embodiment, five irradiation profiles, for example, are prepared as shown in FIGS. 6A-6E. In part (1) of each of FIGS. 6A-6E, the vertical axis represents the laser light irradiation intensity and the horizontal axis represents the position of a subgroup of VCSEL arrays 76 in the feeding direction. Array A to array F on the horizontal axis correspond to those shown in FIG. 2. Part (2) of each of FIGS. 6A-6E shows a time-series variation of ink temperature when laser light irradiation is performed according to the irradiation profile shown in part (1). In part (2) of each of FIGS. 6A-6E, the vertical axis represents the ink temperature and the horizontal axis represents the elapsed time from the start of laser light irradiation. A broken line indicates a boiling temperature.

Figure 6A:
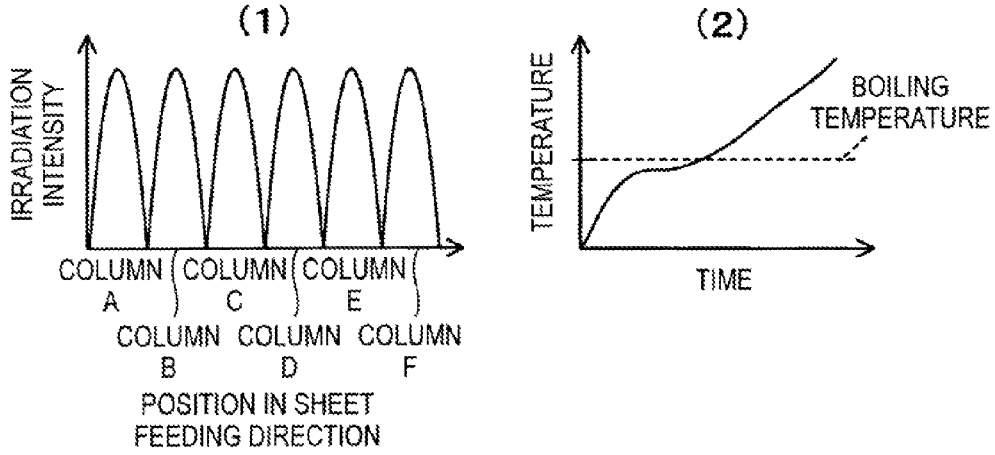
FIG. 6A is that Part (1) of FIG. 6A is a graph showing a relationship between the position of a VCSEL array subgroup in the sheet feeding direction and the laser light irradiation intensity in the case of a first irradiation profile used in the exemplary embodiment, and part (2) of FIG. 6A is a graph showing a relationship between the laser light irradiation time and the ink temperature when laser light irradiation is performed according to the first irradiation profile.

As shown in part (1) of FIG. 6A, in the first irradiation profile used in the exemplary embodiment, the subgroup VCSEL arrays 76 belonging to each control unit emit laser light with a uniform irradiation intensity distribution. When laser light irradiation is performed according to the first irradiation profile, as shown in part (2) of FIG. 6A the ink temperature rises to close to the boiling temperature after the start of the laser light irradiation and then increases slowly. After passing the boiling temperature, the ink temperature increases rapidly. The first irradiation profile is suitable for, for example, a case that the combination of a continuous sheet type and an ink type is such that ink permeates into the continuous sheet P so quickly as not to cause problems of ink boiling and a case that the feeding speed of the continuous sheet P is high and hence the irradiation intensity per unit time is low. Furthermore, where the first irradiation profile is employed, the loads of laser light irradiation by the VCSEL arrays 76 are uniform and hence the VCSEL arrays 76 less likely suffer different degrees of deterioration.

Figure 6B:
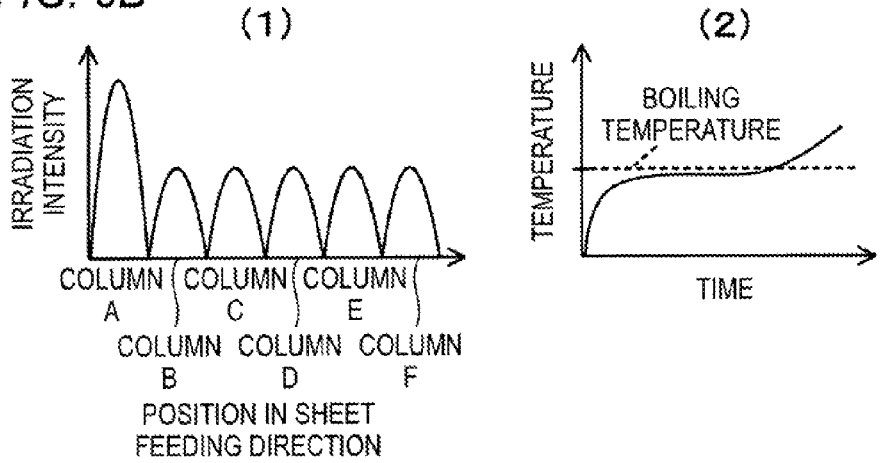
FIG. 6B is that Part (1) of FIG. 6B is a graph showing a relationship between the position of a VCSEL array subgroup in the sheet feeding direction and the laser light irradiation intensity in the case of a second irradiation profile used in the exemplary embodiment, and part (2) of FIG. 6B is a graph showing a relationship between the laser light irradiation time and the ink temperature when laser light irradiation is performed according to the second irradiation profile.

As shown in part (1) of FIG. 6B, in the second irradiation profile used in the exemplary embodiment, the subgroup VCSEL arrays 76 belonging to column A emit laser light at the same irradiation intensity as in the first irradiation profile. The subgroup VCSEL arrays 76 belonging to columns B-F emit laser light at a lower irradiation intensity than those belonging to column A (in the example shown in part (1) of FIG. 6B, the irradiation intensity is approximately halved). When laser light irradiation is performed according to the second irradiation profile, as shown in part (2) of FIG. 6B the ink temperature rises to close to the boiling temperature after the start of the laser light irradiation and then increases slowly while being kept a little lower than the boiling temperature. After passing the boiling temperature, the ink temperature increases rapidly. The second irradiation profile is suitable for, for example, an ink having a large water content and an ink that is fixed to a continuous sheet P when only the water contained in it is evaporated.

Figure 6C:
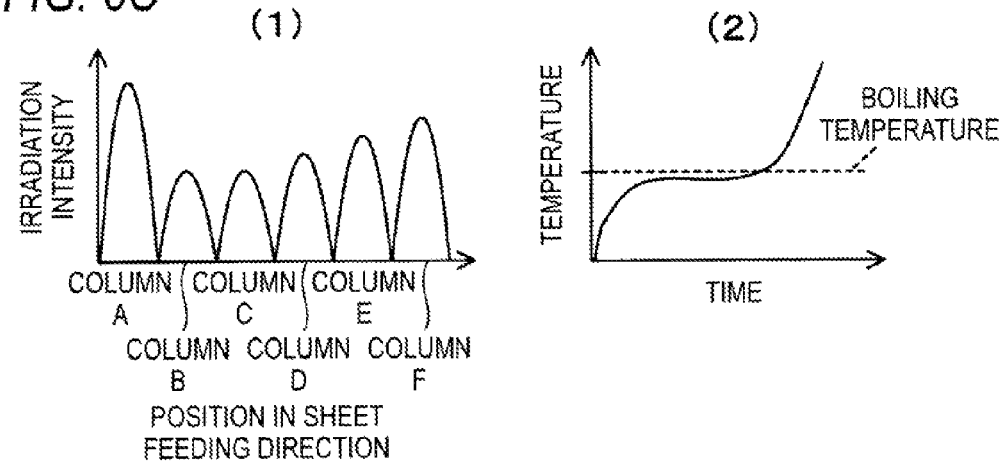
FIG. 6C is that Part (1) of FIG. 6C is a graph showing a relationship between the position of a VCSEL array subgroup in the sheet feeding direction and the laser light irradiation intensity in the case of a third irradiation profile used in the exemplary embodiment, and part (2) of FIG. 6C is a graph showing a relationship between the laser light irradiation time and the ink temperature when laser light irradiation is performed according to the third irradiation profile.

As shown in part (1) of FIG. 6C, in the third irradiation profile used in the exemplary embodiment, the subgroup VCSEL arrays 76 belonging to column A and column B emit laser light at the same irradiation intensities as those do in the second irradiation profile, respectively. The subgroup VCSEL arrays 76 belonging to column C emit laser light at the same irradiation intensity as those belonging to column B do. The subgroup VCSEL arrays 76 belonging to columns D-F emit laser light at irradiation intensities that increase gradually from the irradiation intensity of the subgroup VCSEL arrays 76 belonging to column B and column C. When laser light irradiation is performed according to the third irradiation profile, as shown in part (2) of FIG. 6C the ink temperature passes the boiling temperature earlier and thereafter increases more rapidly than in the case of the second irradiation profile. The third irradiation profile is suitable for, for example, an ink that is fixed well to a continuous sheet P when a high-boiling-temperature solvent is evaporated.

As shown in part (1) of FIG. 6D, in the fourth irradiation profile used in the exemplary embodiment, the subgroup VCSEL arrays 76 belonging to column A and column B emit laser light at the same irradiation intensities as those of the second irradiation profile, respectively. The subgroup VCSEL arrays 76 belonging to columns C-E emit laser light at the same irradiation intensities as those belonging to columns D-F do in the third irradiation profile, respectively. The subgroup VCSEL arrays 76 belonging to column F do not emit laser light. When laser light irradiation is performed according to the fourth irradiation profile, as shown in part (2) of FIG. 6D the ink temperature passes the boiling temperature and then decreases. The fourth irradiation profile is suitable for, for example, a highly dryable ink and a combination of an ink and a continuous sheet P with high ink permeability.

As shown in part (1) of FIG. 6E, in the fifth irradiation profile used in the exemplary embodiment, the subgroup VCSEL arrays 76 belonging to column A and column B emit laser light at the same irradiation intensity as in the first irradiation profile. The subgroup VCSEL arrays 76 belonging to columns C-F emit laser light at the same irradiation intensity as those belonging to columns C-F do in the second irradiation profile. When laser light irradiation is performed according to the fifth irradiation profile, as shown in part (2) of FIG. 6E the ink temperature rises to close to the boiling temperature after the start of the laser light irradiation and then increases slowly while being kept a little lower than the boiling temperature. After passing the boiling temperature, the ink temperature increases rapidly. The fifth irradiation profile is suitable for, for example, an ink having a large water content.

As described above, in each of the irradiation profiles used in the exemplary embodiment, the irradiation intensity of the subgroup VCSEL arrays 76 belonging to column A is higher than the irradiation intensities of the subgroup VCSEL arrays 76 belonging to columns B-F. As a result, the ink temperature rises quickly to close to the boiling temperature and hence inks can be dried efficiently.

In the inkjet recording apparatus 10 according to the exemplary embodiment, the above-described first to fifth irradiation profiles are stored in the storage unit 30 in advance in the form of tables (hereinafter referred to as "irradiation intensity tables") each of which contains irradiation intensities for VCSEL arrays 76 of one unit of control. FIGS. 7A and 7B show example irradiation intensity tables corresponding to the first and second irradiation profiles, respectively. "Columns A-C" in FIGS. 7A and 7B are those shown in FIG. 2, and numerical values such as "1.5" in FIGS. 7A and 7B are irradiation intensities (in J/cm$^2$) of laser light emitted from the VCSEL arrays 76. To avoid making FIGS. 7A and 7B unduly complex, columns D-F are omitted in these drawings.

As shown in FIG. 7A, where the first irradiation profile is used, the subgroup VCSEL arrays 76 of a unit of control emit laser light at an irradiation intensity 1.5 J/cm$^2$. On the other hand, as shown in FIG. 7A, where the second irradiation profile is used, the subgroup VCSEL arrays 76 belonging to column A emit laser light at an irradiation intensity 1.5 J/cm$^2$ and the subgroup VCSEL arrays 76 belonging to columns B-F emit laser light at an irradiation intensity 0.75 J/cm$^2$. Although not shown in any drawings to avoid redundancy, irradiation intensity tables corresponding to the third to fifth irradiation profiles are also stored in the storage unit 30 in advance.

In the exemplary embodiment, the CPU 20A causes the VCSEL arrays 76 of a unit of control to emit laser light by setting not only an irradiation profile but also factors such as "0.8," "0.9," "1.0," or "1.1" by which the irradiation intensities of the irradiation profile are to be changed. For example, if the second profile and a factor "0.8" are set for the VCSEL arrays 76 belonging to row 1-1, the subgroup VCSEL arrays 76 belonging to column A1-1 emit laser light at an irradiation intensity 1.2 J/cm$^2$ and the subgroup VCSEL arrays 76 belonging to columns B1-1 to F1-1 emit laser light at an irradiation intensity 0.6 J/cm$^2$.

At the next step S104, the CPU 20A causes the pressing roller 110 to be moved and thereby pressed against the continuous sheet P that was irradiated with laser light at step S102. The CPU 20A also causes the pressing roller 110 to rotate.

At step S106, the CPU 20A causes the image reading unit 120 to read the test image on the continuous sheet P against which the image reading unit 120 was pressed at step S104 and a region (hereinafter referred to as a "smudge evaluation region") adjacent to the subsequent area of the test image. And the CPU 20A acquires resulting image information.

At step S108, the CPU 20A performs image processing on the image information acquired by step S106 and thereby detects occurrences of ink smudge in the smudge evaluation region and optical densities in regions of the test image corresponding to the respective units of control.

Figure 8:
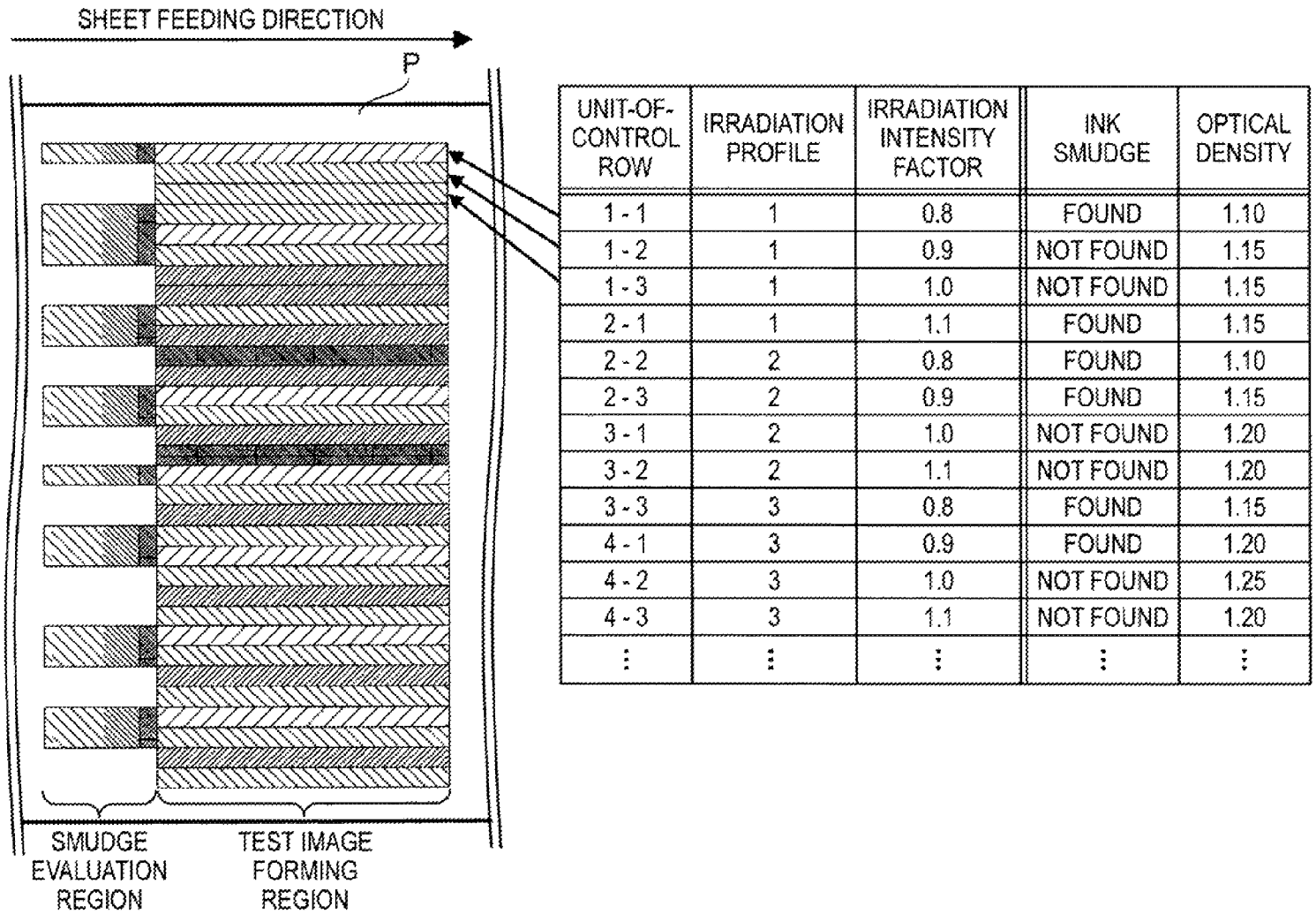
FIG. 8 is a schematic diagram illustrating how to select an irradiation profile and an irradiation intensity factor in the exemplary embodiment.

At step S110, the CPU 20A selects an irradiation profile that provides a maximum optical density without causing ink smudge on the basis of the occurrences of ink smudge and the optical densities detected by step S108. FIG. 8 is a schematic diagram illustrating how to select an irradiation profile. Although in the exemplary embodiment an irradiation profile that provides a maximum optical density is selected, the invention is not limited to such a case. For example, one of irradiation profiles that provide optical densities that are higher than or equal to a reference value (e.g., 1.15) may be selected. As a further alternative, one of irradiation profiles that do not cause ink smudge may be selected (i.e., optical densities are not taken into consideration).

FIG. 8 is a top view of a continuous sheet P that was irradiated with laser light at step S102 and against which the pressing roller 110 was pressed at step S104. As mentioned above, a phenomenon may occur that the optical density of a test image is varied by the laser light irradiation intensity or ink smudge is formed in the smudge evaluation region of the continuous sheet P due to a low degree of fixing of ink to the continuous sheet P. The right-hand table of FIG. 8 show relationships between unit-of-control rows (their numbers are shown in the table) shown in FIG. 2, irradiation profiles (their numbers are shown in the table) that are set for the respective units of control, and irradiation intensity factors and corresponding sets of detection results, that is, presence/absence of ink smudge and optical densities of the test image. For example, in the example of FIG. 8, at step S110, the CPU 20A selects the third irradiation profile and an irradiation intensity factor "1.0" as a combination that provides a maximum optical density without causing ink smudge.

At step S112, the CPU 20A sets, uniformly, the irradiation intensities of the irradiation profile selected at step S110 and the irradiation intensity factor selected likewise for the VCSEL arrays 76 belonging to every unit of control. Then the profile selection program is finished.

A user image is thereafter irradiated with laser light according to the irradiation intensities that have been set for the respective VCSEL arrays 76 by the running of the profile selection program and the irradiation intensity factor that has been set likewise.

Tables 1 and 2 below compare results of Example of the exemplary embodiment and Comparative Examples 1 and 2. Table 1 shows outlines of respective profile selection processes and times taken by the respective profile selection processes when the continuous sheet type is changed from wood free paper to coated paper in a state that the irradiation profile and the irradiation intensity factor are optimized for wood free paper. Table 2 shows optical densities and presence/absence of ink smudge that are detected when user images are irradiated with laser light using irradiation profiles and irradiation intensity factors selected for the respective continuous sheet types. Comparative Example 1 is an example in which each test image is irradiated with laser light using an irradiation profile and an irradiation intensity factor that are set uniformly for all units of control and, as in the exemplary embodiment, an optimum irradiation profile and irradiation intensity factor are selected from optical densities and presence/absence of ink smudge measured or detected from the irradiated test images. On the other hand, Comparative Example 2 is an example in which no processing for selecting an irradiation profile and an irradiation intensity factor is performed. The number of combinations of an irradiation profile and an irradiation intensity factor is equal to 10.

TABLE 1

| | Example | Comparative Example 1 | Comparative Example 2 |
|---|---|---|---|
| Outline of profile selection process | Plural irradiation profiles are evaluated by one irradiation profile selection process in which different combinations of an irradiation profile and an irradiation intensity factor are set for respective units of control. | An irradiation profile selection process in which one irradiation profile is evaluated using the irradiation profile and an irradiation intensity factor that are set uniformly for all units of control is executed plural times while the combination of an irradiation profile and an irradiation intensity factor is changed. | No profile selection process is executed. |
| Time taken | 3 min | 30 min (3 min × 10) | 0 min |

TABLE 2

| | Example | | Comparative Example 1 | | Comparative Example 2 | |
|---|---|---|---|---|---|---|
| Paper type | Woodfree | Coated | Woodfree | Coated | Woodfree | Coated |
| Optical density | 1.1 | 1.2 | 1.1 | 1.2 | 1.1 | 1.15 |
| Ink smudge | Not found | Not found | Not found | Not found | Not found | Found |

As shown in Table 1, in Example of the exemplary embodiment, the profile selection process takes only 3 min because plural combinations of an irradiation profile and an irradiation intensity factor are evaluated by one profile selection process. In contrast, in Comparative Example 1, only one combination of an irradiation profile and an irradiation intensity factor is evaluated by each constituent profile selection process. Since the number of combination is equal to 10, the entire profile selection process takes 30 min (3 min×10). In Comparative Example 2 in which no profile selection process is executed (no time is taken).

As seen from Table 2, Example of the exemplary embodiment and Comparative Example 1 produce the same results in terms of the optical density and the presence/absence of ink smudge of a user image because their profile selection processes are substantially the same whereas they are different from each other in the time taken. In contrast, in Comparative Example 2 in which a coated sheet is irradiated with laser light with the irradiation profile and the irradiation intensity factor kept optimized for woodfree paper, the optical density detected with the coated sheet is lower than in Example of the exemplary embodiment and ink smudge is detected with the coated sheet.

As described above, in Example of the exemplary embodiment, an irradiation profile is selected in a shorter time than in Comparative Example 1 and the degree of image quality degradation is made lower than in Comparative Example 2.

Although the exemplary embodiment of the invention has been described above, the technical scope of the invention is not limited to the exemplary embodiment. A variety of changes and modifications can be made in the embodiment without departing from the spirit and scope of the invention, and resulting modes are also included in the technical scope of the invention.

The exemplary embodiment should not be construed as restricting the claimed invention, and all of the essential features described in the embodiment are not always necessary to attain the object of the invention. The exemplary embodiment includes inventive concepts at various stages and various inventive concepts can be extracted as combinations of constituent elements disclosed therein. Even if several ones are removed from all the constituent elements disclosed in the exemplary embodiment, a resulting mode can be extracted as an inventive concept as long as it can provide the intended advantages.

For example, although in the exemplary embodiment vertical cavity surface-emitting lasers are employed as the laser devices, the invention is not limited to such a case. For example, the laser devices may be semiconductor laser devices of another kind such as horizontal cavity surface-emitting lasers (edge-emitting lasers).

The size, shape, and color of a test image are not limited to those mentioned in the exemplary embodiment. For example, another size, shape, or color of a test image may be employed as long as it makes it possible to detect presence/absence of ink smudge and an optical density of a test image for each unit of control by irradiating the respective unit-of-control groups of VCSEL arrays 76 with laser light using different irradiation profiles.

Although in the exemplary embodiment the unit of control is one row of VCSEL arrays 76 arranged in the feeding direction, the invention is not limited to such a case. For example, the unit of control may be plural rows (e.g., adjoining rows) of VCSEL arrays 76 arranged in the feeding direction.

Although in the laser drying device 70 according to the exemplary embodiment the laser drying units 72A-72F are arranged in the feeding direction at intervals, the invention is not limited to such a case. For example, the laser drying device 70 may be configured in such a manner that the laser drying units 72A-72F are arranged in the feeding direction with no intervals formed between them. For another example, the laser drying device 70 may be configured in such a manner that the laser drying units 72A-72F are integrated together.

Although in the exemplary embodiment the irradiation intensities of an irradiation profile are changed using an irradiation intensity factor, the invention is not limited to such a case. For example, each irradiation profile may be formed so as to incorporate an irradiation intensity factor. It goes without saying that the number of irradiation profiles and the number of irradiation intensity factors are not limited to the above-mentioned numbers.

Although in the exemplary embodiment presence/absence of ink smudge and optical densities of a test image are detected from image information that represents an image read by the image reading unit 120, the invention is not limited to such a case. For example, an optimum irradiation profile and an irradiation intensity factor may be selected by a user by judging presence/absence of ink smudge and optical density levels of a test image visually. In this case, for example, the user sets the selected irradiation profile and irradiation intensity factor in the inkjet recording apparatus 10 through the manipulation/display unit 140 or the like.

Although in the exemplary embodiment presence/absence of ink smudge is detected from image information that represents an image read by the image reading unit 120, the invention is not limited to such a case. For example, presence/absence of ink smudge may be detected by a sensor or the like that detects densities of an image formed in a smudge evaluation region of a continuous sheet P.

Although in the exemplary embodiment the image reading unit 120 is provided inside the inkjet recording apparatus 10, the invention is not limited to such a case. For example, the image reading unit 120 may be provided in an external device provided outside the inkjet recording apparatus 10.

Although not described in the exemplary embodiment, the image reading unit 120 may also serve as a device for detecting, for example, pin disengagement of the nozzles of the printing heads 50.

Although in the exemplary embodiment a continuous sheet P is used as a recording medium, the invention is not limited to such a case. For example, A4, A3, or like cut sheets may be used as recording media. The material of a recording medium is not limited to paper; a recording medium made of another material may be used as long as ink placed on it as a result of ejecting of ink droplets is dried and fixed to it when irradiated with laser light.

Although in the exemplary embodiment various programs are installed in the ROM 20B in advance, the invention is not limited to such a case. For example, various programs may be provided being stored in such a recording medium as a CD-ROM (compact disc-read only memory) or being transmitted over an external network.

Although in the exemplary embodiment the profile selection process is implemented by software using a computer, that is, by running a program, the invention is not limited to such a case. For example, the profile selection process may be implemented by hardware or a combination of hardware and software.

The configurations of the inkjet recording apparatus 10 (FIGS. 1-3) according to the exemplary embodiment is just an example. It goes without saying that deletion of unnecessary elements and addition of new elements are possible without departing from the spirit and scope of the invention.

The procedure of the profile selection program (FIG. 5) according to the exemplary embodiment is just an example. It goes without saying that deletion of unnecessary steps, addition of new steps, and changing of the order of execution of steps are possible without departing from the spirit and scope of the invention.

The structure of the tables (see FIGS. 7A and 7B) used in the exemplary embodiment is just an example; it goes without saying that the structure may be changed without departing from the spirit and scope of the invention.

What is claimed is:

1. A drying device comprising:

a plurality of drying units, each drying unit comprising a plurality of laser light sources that are arranged two-dimensionally, and that dry ink placed on a recording medium as a result of ejecting of ink droplets from an ejecting unit by irradiating the ink with laser light;

a control unit that divides the laser light sources of each drying unit into a plurality of laser light source subgroups, each having the same number of laser light sources, that are arranged in a crossing direction that crosses a feeding direction of the recording medium, and each laser light source subgroup having, as a unit of control, a plurality of the laser light sources arranged in the feeding direction of the recording medium, the control unit groups the laser light source subgroups of the drying units into rows in the feeding direction of the recording medium to form respective unit-of-control laser light source groups, and the control unit controls the drying unit using laser light irradiation profiles that are set for the respective unit-of-control laser light source groups; and a setting unit that causes the drying units to radiate laser light on a test image formed on the recording medium by ink droplets ejected from the ejecting unit using different irradiation profiles for the respective unit-of-control laser light source groups, and sets an irradiation profile that provides an evaluation result, better than or equal to a reference, of the test image as irradiated with laser light for laser light sources belonging to each of the unit-of-control laser light source groups.

2. The drying device according to claim 1, wherein:

each of the irradiation profiles comprises laser light irradiation intensities that are set for respective laser light source subgroups obtained by dividing a unit-of-control laser light source group in the feeding direction; and an irradiation intensity of a most upstream laser light source subgroup in the feeding direction is higher than or equal to irradiation intensities of other laser light source subgroups.

3. The drying device according to claim 1, wherein:

each of the irradiation profiles comprises laser light irradiation intensities;

the control unit controls the drying unit using irradiation intensity factors in addition to the irradiation profiles; and the setting unit causes the drying units to radiate laser light on the test image using different combinations of an irradiation profile and an irradiation intensity factor for the respective unit-of-control laser light source groups, and sets an irradiation profile and an irradiation intensity factor that provide an evaluation result, better than or equal to the reference, of the test image as irradiated with laser light for the laser light sources belonging to each of the unit-of-control laser light source groups.

4. The drying device according to claim 1, wherein each of the laser light sources comprises vertical cavity surface-emitting lasers.

5. An image forming apparatus comprising:

the drying device according to claim 1;

the ejecting unit; and a feeding mechanism that feeds the recording medium.

6. The image forming apparatus according to claim 5, further comprising a detection unit that detects smudge on an image forming surface of the recording medium, wherein the evaluation result of the test image is judged better than or equal to the reference if no smudge is detected by the detection unit.

7. The image forming apparatus according to claim 6, wherein the detection unit comprises:

a pressing member that is pressed against the test image as irradiated with laser light; and a reading unit that reads the test image as subjected to the pressing by the pressing member and a portion, adjacent to a subsequent area of the test image, of the recording medium; and wherein the detection unit detects smudge based on an image read by the reading unit.

8. The image forming apparatus according to claim 7, wherein the evaluation result of the test image is judged better than or equal to the reference if a criterion that an optical density of the test image read by the reading unit is higher than or equal to a predetermined reference value is satisfied additionally.

9. The image forming apparatus according to claim 5, wherein the setting unit sets an irradiation profile upon occurrence of at least one of events that a type of the ink has been changed, a type of the recording medium has been changed, regular maintenance work has been carried out, and special maintenance work has been carried out.

10. A non-transitory computer readable medium storing a program causing a computer to function as the control unit and the setting unit of the drying device according to claim 1.

* * * * *